US006837086B2

(12) United States Patent
Manabe et al.

(10) Patent No.: US 6,837,086 B2
(45) Date of Patent: Jan. 4, 2005

(54) HOT ISOSTATIC PRESSING METHOD AND APPARATUS

(75) Inventors: Yasuo Manabe, Takasago (JP); Shigeo Kofune, Takasago (JP); Makoto Yoneda, Takasago (JP); Takao Fujikawa, Takasago (JP)

(73) Assignee: Kobe Steel, Ltd., Kobe (JP)

( * ) Notice: Subject to any disclaimer, the term of this patent is extended or adjusted under 35 U.S.C. 154(b) by 57 days.

(21) Appl. No.: 10/446,671

(22) Filed: May 29, 2003

(65) Prior Publication Data

US 2003/0221469 A1 Dec. 4, 2003

(30) Foreign Application Priority Data

May 29, 2002 (JP) ..... 2002-156293

(51) Int. Cl.[7] ..... B21D 26/02

(52) U.S. Cl. ..... 72/56; 72/364; 72/453.06; 100/269.14; 100/305

(58) Field of Search ..... 72/54, 56, 57, 72/342.1, 364, 453.02, 453.06; 419/42, 49; 264/570; 425/405.2; 100/305, 315, 316, 317, 269.05, 269.08, 269.14, 269.16

(56) References Cited

U.S. PATENT DOCUMENTS 4,942,750 A * 7/1990 Conaway ..... 72/56
5,979,306 A * 11/1999 Fujikawa et al. ..... 100/90
6,159,400 A * 12/2000 Laquer ..... 264/39
6,533,997 B1 * 3/2003 Bergman ..... 419/49

FOREIGN PATENT DOCUMENTS

JP 7-23484 3/1995

* cited by examiner

*Primary Examiner*—Ed Tolan
(74) *Attorney, Agent, or Firm*—Oblon, Spivak, McClelland, Maier & Neustadt, P.C.

(57) ABSTRACT

While a workpiece is heated and pressed by one of a pair of high-pressure vessels, a workpiece being pressed by the other high-pressure vessel is placed in a heated state. In the reducing process after termination of heating and pressing treatment of the workpiece by one high-pressure vessel, both the high-pressure vessels are placed in communication, and the pressure medium gas released from one high-pressure vessel is poured into the other high-pressure vessel. After pressures of both the high-pressure vessels have assumed a nearly balanced state, the pressure medium gas is sucked out of one high-pressure vessel by a compressor and pressed, and is poured into the other high-pressure vessel, and the workpiece is heated and pressed by the other high-pressure vessel. By the method as described, considerable shortening of cycle time of HIP treatment is achieved, and the HIP treatment can be carried out with high efficiency.

11 Claims, 12 Drawing Sheets

OPERATING CYCLE OF HIGH-EFFICIENCY HIP APPARATUS

PRESSURE AND TEMPERATURE WITHIN BOTH HIP VESSELS

HOT ISOSTATIC PRESSING METHOD AND APPARATUS

BACKGROUND OF THE INVENTION

1. Field of the Invention

The present invention relates to a hot isostatic pressing apparatus (HIP apparatus) for economically performing a treatment of a large quantity of products capable being carried under the atmospheric pressure in the heated state such as Al cast products Mg cast products or the like and whose hot isostatic pressing treatment (HIP treatment) temperature is not more than 600° C., and particularly to a method and apparatus wherein two high-pressure vessels are combined and operation is carried out whereby pressing and pressure reducing are carried out in a short period of time to realize shortening of cycle time and to improve economic properties of the HIP treatment.

2. Description of the Related Art

The problem on industrial popularization of the HIP treatment of cast pieces of light-alloy metal materials such as Al and Mg which are objects of the present invention basically lies in economic properties, that is, treatment costs. In the cost of the HIP treatment, the treatment cost is very high due to long cycle time. The present invention aims at shortening the cycle time and improvement of economic properties resulting from improvement of apparatus utilizing efficiency. The related art proposed to improve the HIP treatment technique from a viewpoint of the foregoing and the problem thereof will be explained hereinafter.

A compressor for pressing a pressure medium gas, a reducing device for reducing pressure, and various valves are also expensive. There has been also proposed a method in which a pressing and reducing system constituted of these (expensive) parts is by 20 to 40% in operating time at one cycle, and therefore, a plurality of high-pressure vessels are connected to the pressing and reducing system, and operation is carried out so as to shift an operating phase to reduce stop-time of the compressor whereby the apparatus price is relatively reduced (see FIG. 12, Japanese Patent Publication No. 23484/1995).

The above-proposed HIP apparatus 67 comprises, as shown in FIG. 12, two high-pressure vessels 68, and a pressing/reducing system 72 provided with a gas cylinder 69, a gas compressor 70, a reducing device 71 and many valves, whereby the start time of cycle motion in the high-pressure vessels 68 is shifted. When in one high-pressure vessel 68, heating/pressing treatment of workpieces is carried out, pressing/recovering process of the pressure medium gas is carried out in the other high-pressure vessel 68 to thereby enhance working efficiency of the HIP apparatus 67. The single pressing/reducing system 72 is operated relative to the two high-pressure vessels 68, and the start time of cycle motion in each high-pressure vessel 68 is shifted, thus achieving the improvement of efficiency of the HIP treatment.

However, in the technique described in the above Japanese Patent Publication No. 23484/1995, the pressure medium gas is supplied from the gas cylinder 69 to one high-pressure vessel 68 by the gas compressor 70, and afterwards, the pressure medium gas is recovered to the gas cylinder 69 from the other high-pressure vessel 68 by the gas compressor 70. Therefore, during the time when one high-pressure vessel 68 is elevated in pressure, the other high-pressure vessel 68 cannot be reduced in pressure. Accordingly, this poses a problem that the portion cannot shorten the cycle time of the HIP treatment.

It is noted that the HIP apparatus 67 described in the above Japanese Patent Publication No. 23484/1995 discloses that after termination of the HIP treatment in one high-pressure vessel 68, the valves 73 and 74 are opened to communicate both the high-pressure vessels 68 each other, whereby a high-pressure argon gas is introduced from one high-pressure vessel 68 to the other high-pressure vessel 68 to shorten the pressing time. However, there is not disclosed a method in which after pressures within both the high-pressure vessels 68 assume a balanced state, the other high-pressure vessel 68 (a high-pressure vessel supplied with the argon gas) is elevated to the HIP treatment pressure.

Further, the technique described in the above Japanese Patent Publication No. 23484/1995 for connecting in common the pressing/reducing system 72 to the plurality of high-pressure vessels 68 describes nothing about the state of temperatures within the high-pressure vessel 68. As will be carried out here, where gases are supplied at high speed making use of a pressure difference between the HIP treatment vessel in the high-pressure state and the HIP treatment vessel intended to elevate pressure thereafter, a temperature-elevating phenomenon due to so-called damming occurs whereby a temperature above the treatment chamber of the HIP treatment vessel intended to elevate pressure thereafter excessively rises. Thereby, in the control of electric power input into a heater, a temperature distribution which is difficult to control temperature occurs. In workpieces formed of a material which is difficult in temperature control, that is, variation in temperature of the workpieces becomes so great as to require heat treatment, it is difficult to secure the expected mechanical characteristics. It is impossible to avoid this problem, and it is difficult to carry out the stabilized HIP treatment to which is attached importance of uniform temperature. It is an object of the present invention to solve the aforementioned problems.

SUMMARY OF THE INVENTION

The technical means taken by the present invention to solve the technical problem provides a hot isostatic pressing method for heating/pressing a workpiece using a pair of high-pressure vessels and using a pressure medium gas. The method comprises the steps of: heating and pressing workpieces in a first high-pressure vessel which is one of the pair of high-pressure vessels; placing a workpiece in a heating state in a second high-pressure vessel which is the other thereof, while heating and pressing the workpieces in the first high-pressure vessel; reducing the internal pressure of the first high-pressure vessel, after termination of heating and pressing of the workpieces in the first high-pressure vessel; pressing the interior of the second high-pressure vessel, while reducing the internal pressure of the first high-pressure vessel; and heating and pressing the workpieces in the second high-pressure vessel. In the above process, the step of pressing the interior of the second high-pressure vessel and reducing the internal pressure of the first high-pressure comprises communicating the interior of the first high-pressure vessel with the interior of the second high-pressure vessel to thereby pour the pressure medium gas released from the first high-pressure vessel into the second high-pressure vessel; and sucking out the pressure medium gas from the first high-pressure vessel by a compressor and pouring the pressure medium gas pressed by the compressor into the second high-pressure vessel, after internal pressure of the first high-pressure vessel and internal pressure of the second high-pressure vessel have assumed a nearly balanced state.

The cycle time of the HIP treatment is considerably shortened, and the HIP treatment can be carried out with high efficiency, by the method as described above.

In the above-described hot isostatic pressing method, in the step of reducing the internal pressure of the first high-pressure vessel, the interior of the first high-pressure vessel can be heated so as to suppress lowering of temperature within the first high-pressure vessel.

Thereby, it is possible to avoid the problem that the pressure medium gas within the high-pressure vessel on the supply side is lowered in temperature to substantially lower the pressure.

In the above-described hot isostatic pressing method, a base heater and a fan for supplying and stirring the pressure medium gas within a treatment chamber for heating and pressing workpieces can be arranged downward of a workpiece in the first high-pressure vessel, and the base heater and the fan can be operated so as to provide a uniform temperature in the interior of the first high-pressure vessel, in said step of reducing the internal pressure of the first high-pressure vessel.

Thereby, it is possible to suppress the temperature variation (occurrence of temperature distribution) caused by temperature elevation due to damming which occurs where the pressure medium gas is poured into the high-pressure vessel at high speeds, or it is possible to suppress the temperature-lowering (occurrence of temperature distribution) caused by the adiabatic expansion which occurs where the pressure medium gas within the high-pressure vessel is discharged at high speeds to contribute to the shortening of the cycle time of the HIP treatment.

In the above-described hot isostatic pressing method, it is suitable that said pressure medium gas is nitrogen. Since nitrogen is small in compressive property by 5 to 10% as compared with argon, nitrogen is used as the pressure medium gas used to heat and press the workpieces whereby less gas quantity necessary for pressing to the same pressure as argon gas normally used will suffice to enable the effect of shortening the pressing time. Further, since nitrogen gas is cheaper than argon gas, the cost of the HIP treatment can be lowered.

In the above-described hot isostatic pressing method, the workpiece can be aluminum or an aluminum alloy.

Further, a hot isostatic pressing apparatus for carrying out the above-described hot isostatic pressing apparatus comprises: a first and a second high-pressure vessels having means for heating the interior thereof, pressure medium gas supply means for supplying the pressure medium gas to the first and second high-pressure vessels; a compressor; a first gas passage for communicating the first high-pressure vessel with the second high-pressure vessel; a second gas passage for communicating the first high-pressure vessel with a discharge side of the compressor; a third gas passage for communicating the second high-pressure vessel with a discharge side of the compressor; a fourth gas passage for communicating the first high-pressure vessel with an intake side of the compressor; and a fifth gas passage for communicating the second high-pressure vessel with an intake side of the compressor. Here, the first to fifth gas passages and the compressor are possible to assume at least the following states: a first state in which all the first to fifth gas passages are closed, and the compressor is stopped; a second state in which the first gas passage is open, the fourth and the fifth gas passages are closed, and the compressor is stopped; a third state in which the first gas passage is closed, the second and said fifth gas passages are open, the third and the fourth gas passages are closed, and the compressor is driven to suck out the pressure medium gas from the first high-pressure vessel and supply a high-pressure pressure medium gas to the second high-pressure vessel; and a fourth state in which the first gas passage is closed, the second and said fifth gas passages are open, the third and the fourth gas passages are closed, and the compressor is driven to suck out the pressure medium gas from the second high-pressure vessel and supply a high-pressure pressure medium gas to the first high-pressure vessel.

In the above-described hot isostatic pressing method, operation can be made at least in the following procedure: in the first state, a workpiece is heated and pressed in the first high-pressure vessel, and a workpiece is placed in the heated state in the second high-pressure vessel; after termination of heating and pressing the workpiece in the first high-pressure vessel, the internal pressure of the first high-pressure vessel is reduced and at the same time the interior of the second high-pressure vessel is pressed, in the second state, after internal pressure of the first high-pressure vessel and internal pressure of the second high-pressure vessel have assumed a nearly balanced state, the internal pressure of the first high-pressure vessel is further reduced, and at the same time, the interior of the second high-pressure vessel is further pressed, in the third state; in the first state, the workpiece is heated and pressed in said second high-pressure vessel, and a workpiece is placed in a heated state in the first high-pressure vessel; after termination of heating and pressing the workpieces by said second high-pressure vessel, the internal pressure of the second high-pressure vessel is reduced, and at the same time, the interior of said first high-pressure vessel is pressed, in the second state; and after internal pressure of the first high-pressure vessel and internal pressure of the second high-pressure vessel have assumed a nearly balanced state, the internal pressure of the second high-pressure vessel is further reduced, and at the same time, the interior of the first high-pressure vessel is further pressed, in the fourth state.

In the hot isostatic pressing apparatus, the first and second high-pressure vessels can be constituted so as to have therein a treatment chamber for heating and pressing a workpiece, a base heater arranged downward of the treatment chamber, and a fan for supplying and stirring the pressure medium gas heated by the base heater into the treatment chamber. Further, in the hot isostatic pressing apparatus, the first and second high-pressure vessels can be constituted so as to provide with a heat insulating structure for covering the lateral circumference and upper portion of the treatment chamber. Further, the heat insulating structure can be constituted to be able to be taken out at least with a workpiece and carried from the interior of the first and second high-pressure vessels.

DESCRIPTION OF THE PREFERRED EMBODIMENTS

The preferred embodiments of the present invention will be described hereinafter with reference to the accompanying drawings.

Figure 4:
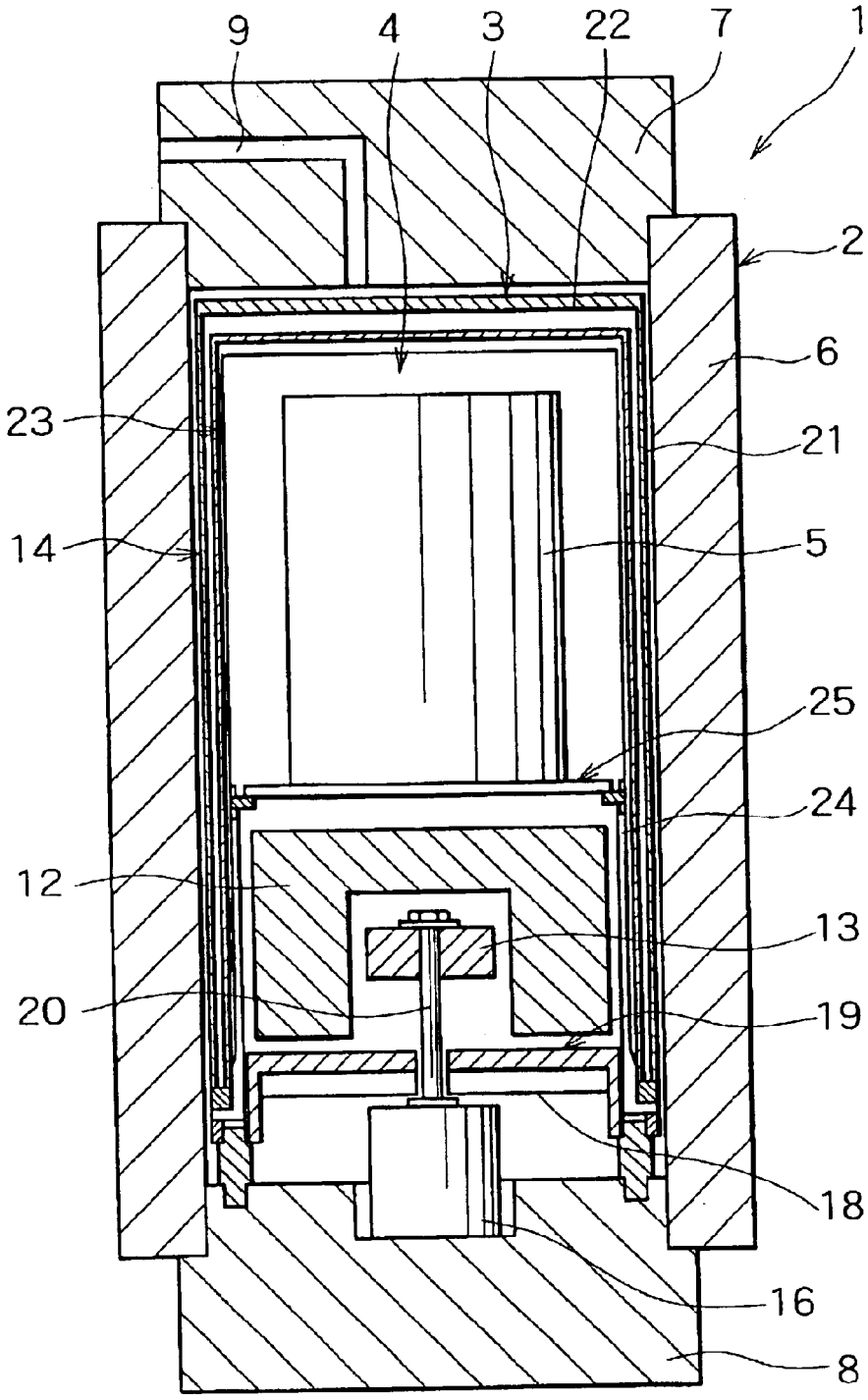
FIG. 4 is a sectional view of a high-pressure vessel of the HIP apparatus and an electric furnace.

FIG. 4 shows one example of a high-pressure vessel 2 and an electric furnace 3, which are the body portion of a hot isostatic pressing apparatus (HIP apparatus) 1 according to the present invention. The HIP apparatus 1 heats a workpiece 5 within a treatment chamber 4 within the electric furnace 3 encased in the high-pressure vessel 2, and pours a pressure medium gas into the high-pressure vessel 2 to elevate pressure and apply heating and pressing treatment (HIP treatment) to the workpiece 5.

The high-pressure vessel 2 comprises a high-pressure cylinder 6 having a vertical axis and which is open in top and bottom, an upper lid 7 for closing an upper-end opening of the high-pressure cylinder 6, and a lower lid 8 for closing a lower-end opening of the high-pressure cylinder 2, wherein the load exerting on the upper and lower lids 7 and 8 is supported by a window frame-like press frame (not shown) by pressure of the pressure medium gas poured into the high-pressure vessel 2.

The upper lid 7 is formed with a gas flowpassage 9 for introducing the pressure medium gas into the high-pressure vessel 2 or discharging the pressure medium gas from the high-pressure vessel 2.

The electric furnace 3 comprises a base heater 12 for heating the pressure medium gas to heat and temperature-elevate the workpiece 5, a fan 13 for forced-convecting the pressure medium gas heated by the base heater 12 to supply and stir it in the treatment chamber 4 for providing a uniform temperature therein, and a heat insulating structure 14 for preventing the high-pressure vessel 2 from being excessively elevated in temperature due to the heat transferred to the high-pressure vessel 2.

The base heater 12 is arranged downward the treatment chamber 4, and the base heater 12 is constructed so that the pressure medium gas may flow in the vertical direction.

The fan 13 is arranged in the central portion within the high-pressure vessel 2 under the base heater 12, and is rotated about the vertical axis to thereby suck the pressure medium gas from the lower or lateral (horizontal direction) side (circumference) and discharge it upward.

A support bed 19 supported on the lower lid 8 is provided below the base heater 12 and the fan 13. A motor 16 for driving the fan 13 is provided between the support bed 19 and the lower lid 8.

An insulating material 18 of ceramic system is provided upward of the motor 16 in order to prevent a damage of the motor 16 due to the heat from the base heater 12. An output shaft 20 of the motor 16 is connected to the fan 13 extending through the heat insulating material 18 and the support bed 19.

A support tube 24 is supported on the support bed 19 so as to surround the base heater 12. A workpiece bed 25 positioned upward of the base heater 12 is provided on the upper end side of the support tube 24. The workpiece 5 is put on the workpiece bed 25.

The each workpiece bed 25 is formed with a vertical through-hole so that the pressure medium gas may flow vertically.

The heat insulating structure 14 comprises a cylindrical trunk 21 for covering the lateral circumference of the treatment chamber 4 and an upper wall 22 for closing an upper-end opening of the trunk 21 to cover the above of the treatment chamber 4, so that the heat insulating structure 14 is formed to be opened in lower end thereof.

The heat insulating structure 14 is placed and supported on the support bed 19, and also covers the support tube 24, the base heater 12 and the fan 13.

Further, on the support tube 24 is supported a tube 23 opened in top and bottom thereof arranged between the heat insulating structure 14 and the workpiece 5.

Moving the lower lid 8 up and down, for example, may move the workpiece 5 and the electric furnace 3 in and out of the high-pressure vessel 2.

The electric furnace 3 is detachably mounted on the lower lid 8 so that it is removed from the lower lid 8 and can be carried integrally with the workpiece 5. The workpiece 5 is preheated, while being received within the electric furnace 3, in a preheating station, and the thus preheated workpiece 5 can be carried, integral with the electric furnace 3, to a HIP station in which the high-pressure vessel 2 is installed.

Further, after the HIP treatment, the workpiece 5 can be carried, integral with the electric furnace 3, to a heat treatment station.

Alternatively, the heat insulating structure 14 is made detachable relative to the lower lid 8 leaving the base heater 12, the fan 13 and the motor 16 on the lower lid 8, and the heat insulating structure 14 and the workpiece 5 may be carried separately from the base heater 12, the fan 13, the motor 16 and the lower lid 8.

In the high-pressure vessel 2 constituted as described above, the pressure medium gas sucked in the fan 13 from the downward or sideward of the fan 13 is discharged upward, and the pressure medium gas heated in the space where the base heater 12 is arranged is made to flow upward forcedly to heat the workpiece 5 within the treatment chamber 4 defined by the tube 23.

Further, it is constituted so that for example, the pressure medium gas is circulated such that the pressure medium gas flown upward of the treatment chamber 4 passes through a clearance between the tube 23 and the upper wall 22 of the heat insulating structure at the upper end of the treatment chamber 4, flows downward of the space externally of the tube 23, and arrives at the downward of the fan 13 from the lower side of the support tube 24.

The effect of the stirring/forced convection of the pressure medium gas by the fan 13 is very effective when the workpiece 5 is being processed under the high pressure, of course; for the purpose of suppressing the occurrence of temperature distribution due to the total elevation of temperature at the time of rapid pressing (at the time of rapidly pouring the pressure medium gas); and for preventing the temperature-lowering due to the adiabatic expansion at the time of rapid reduction (at the time of rapid discharge of the pressure medium gas).

That is, it is necessary for shortening the cycle time of the HIP treatment to shorten the occupying time of the high-pressure vessel 2 of the workpiece 5, and in the high efficiency HIP in which one cycle is within one hour, the shortening of pressure elevation/reducing time is important.

To this end, it is necessary to pour and discharge the gas at high speeds. However, actually, at the time of high-speed pouring, the temperature variation due to the temperature elevation occurs, and at the time of high-speed discharge, the gas within the high-pressure vessel 2 lowers in temperature due to the adiabatic expansion, and therefore, it is difficult to hold temperature where the heat treatment (such as water quench, prescription separating treatment or the like) is jointly carried out immediately after the HIP treatment.

To solve the above problem, the workpiece 5 is heated and pressed within the treatment chamber 4 while supplying and stirring the heated pressure medium gas into the treatment chamber 4 by the operation of the fan 13. The operation enables suppressing the temperature variation (occurrence of temperature distribution) due to the total elevation of temperature which occurs when the pressure medium gas is poured into the high-pressure vessel 2 at high speeds. Therefore, the pressure elevating time caused by the pressure medium gas within the high-pressure vessel 2 is shortened, and the cycle time of the HIP treatment is shortened.

When the pressure medium gas is discharged from the high-pressure vessel 2 after the workpiece 5 has been heated and pressed, the base heater 12 and the fan 13 are operated to thereby prevent the lowering of temperature caused by the adiabatic expansion which occurs where the pressure medium gas within the high-pressure vessel 2 is discharged at high speeds. The operation of the base heater 12 and the fan 13 maintains the temperature of the workpiece 5 at a predetermined temperature, when the heat treatment is carried out continuously after the HIP treatment and the pressure medium gas is discharged from the high-pressure vessel 2. Therefore, the reducing time by the pressure medium gas within the high-pressure vessel 2 and the cycle time of the HIP treatment can be shortened.

In the above-described constitution, the lower lid 8 is substantially constituted by one piece, and the base heater 12 is provided thereon. In heating in an area of temperature below 600° C., radiation heat transfer is not much contributed, and therefore, the heat transfer caused by convection of the pressure medium gas will be the main heat transfer. Therefore, the heater 12 is arranged under the workpiece 5 to make use of an air current which the pressure medium gas heated by the heater 12 generates, and the fan 13 is provided on the lower side of the heater 12 to generate forced convection to heat and elevate in temperature the workpiece 5 efficiently.

Further, the temperature within the treatment chamber is 600° C. at the most. To prevent the excessive rise of temperature in the high-pressure vessel 2 caused by the heat transferred to the high-pressure vessel 2, the heat insulating structure 14 comprising a combination of inner and outer walls in the shape of a reversed tumbler made of metal and an heat insulating material of a ceramic blanket filled between the inner and outer walls will suffice.

As described above, as compared to the furnace of the conventional HIP apparatus, the construction is extremely simplified, and not only the cost of the furnace itself is reduced but since one set of heating power supplies will suffice, the structure of the entire apparatus is also simplified.

As to the heat insulating performance of the aforementioned heat insulating structure 14, heat loss in the vicinity of atmospheric pressure is 1/10 to 1/8 of that at the time of high pressure of nitrogen gas 100 MPa. If the quantity of the workpieces 5 is sufficient under the atmospheric pressure, even if leaving for 30 minutes, the lowering of temperature is less than 10° C. The heat insulating performance of the aforementioned heat insulating structure 14 is very effective in the case where the temperature is desired to be held in the vicinity of the temperature of the HIP treatment at the time of preheating or after the HIP treatment.

Figure 1:
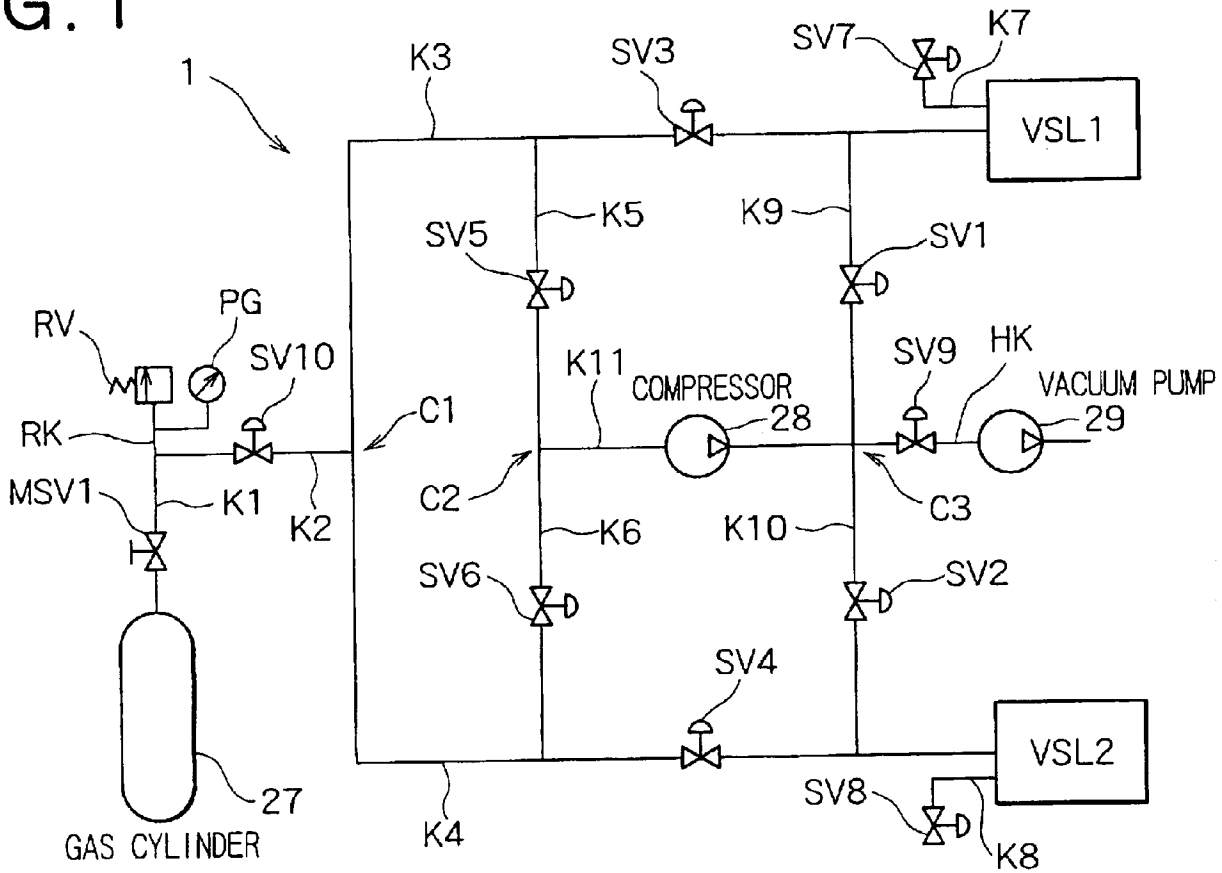
FIG. 1 is a piping systematic view showing a high pressure piping system of a HIP apparatus.
Figure 2:
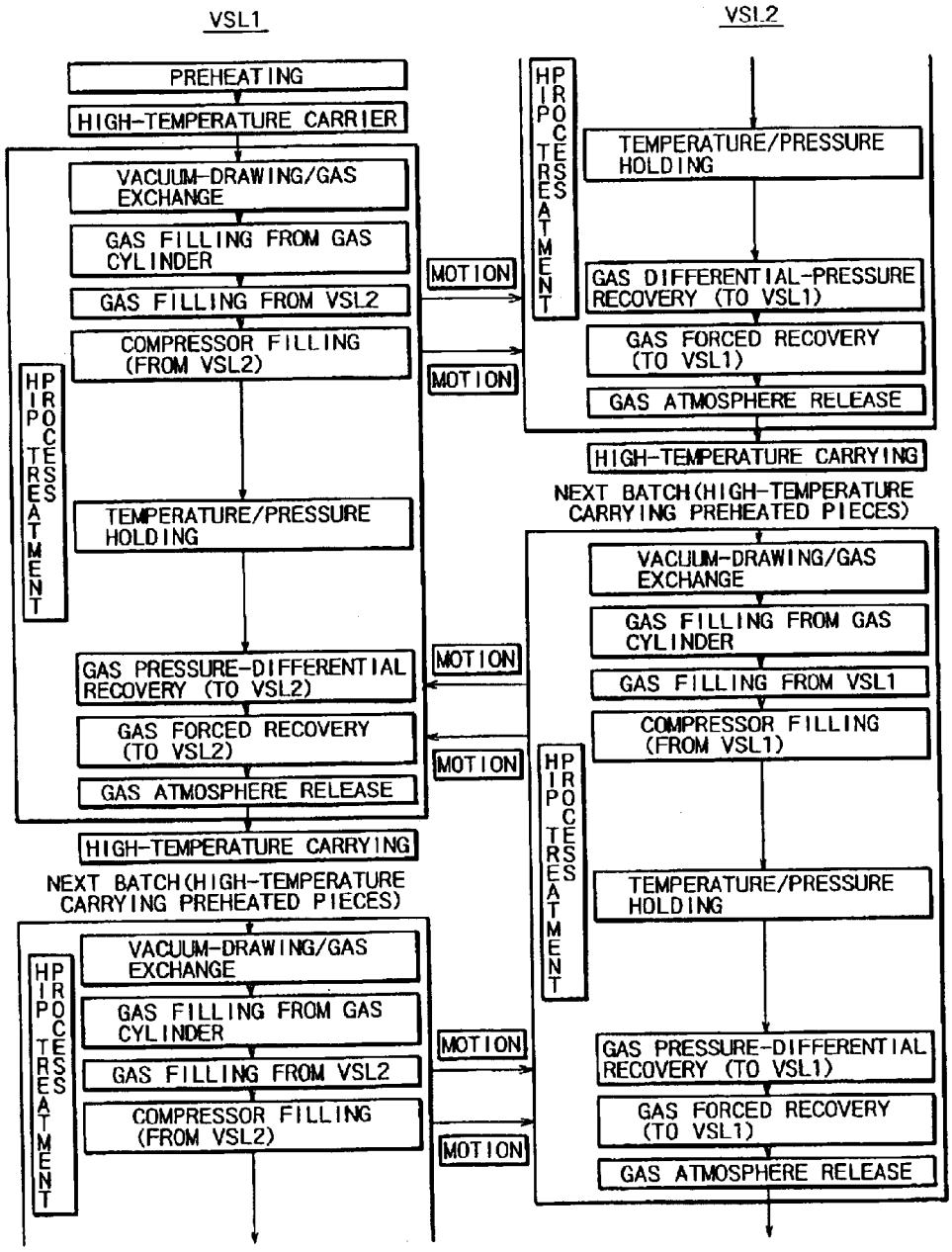
FIG. 2 is a process view showing an operating cycle of two high-pressure vessels.
Figure 3:
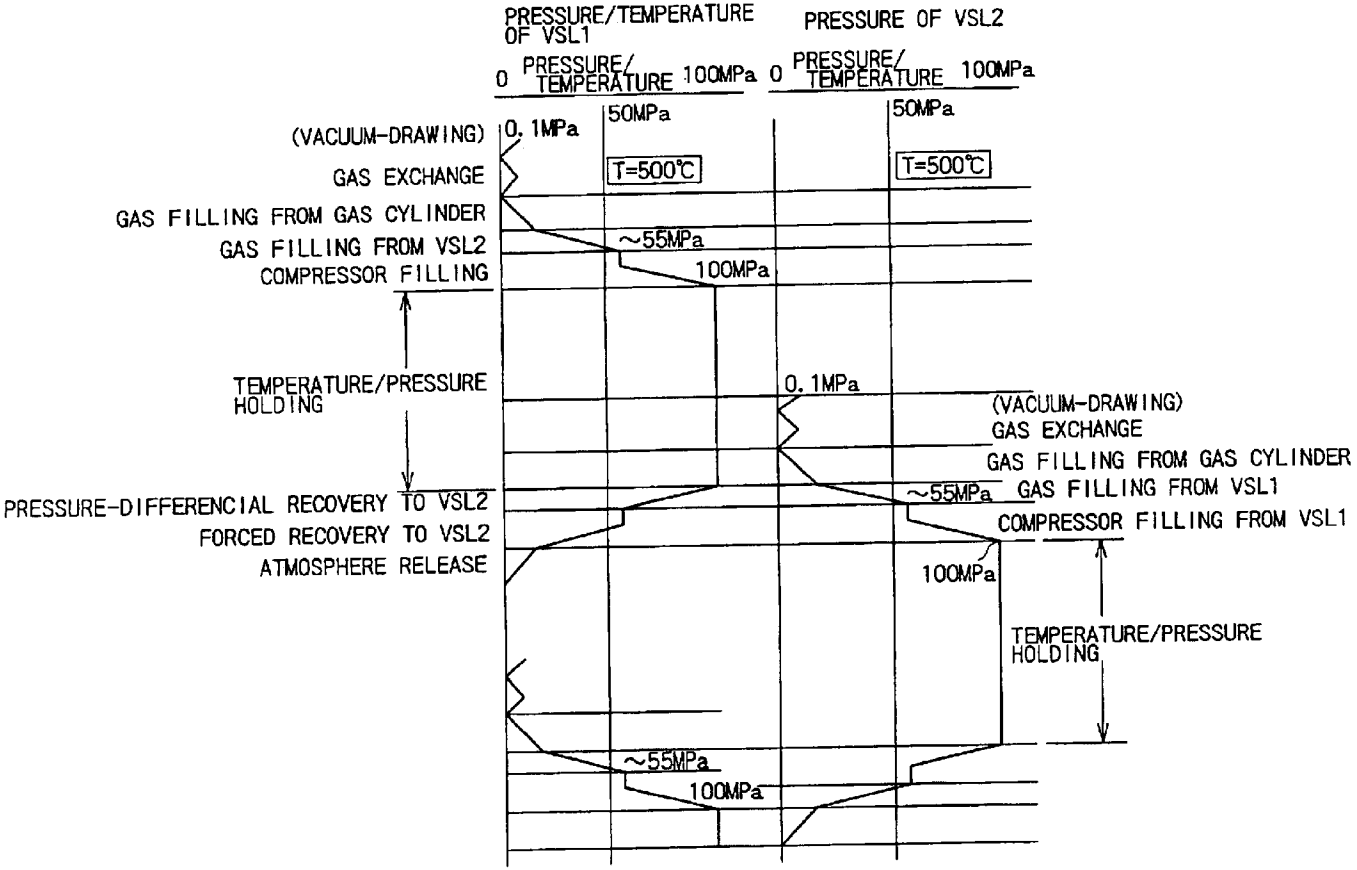
FIG. 3 is a graphical representation showing a relationship between a gas pressure and a temperature within two high-pressure vessels.

FIG. 1 is a high-pressure piping systematic view (a gas circuit view) schematically showing a high-pressure piping system of the HIP apparatus 1 according to the present invention; FIG. 2 is a process view showing operation of pressure of a pressure medium gas of two high-pressure vessels 2 in the high-pressure piping system of FIG. 1 with one high-pressure vessel 2 as a main body; and FIG. 3 is a graph showing a relationship between pressure and temperature of the pressure medium gas within two high-pressure vessels in the high-pressure piping system of FIG. 1.

In the high-pressure piping system (gas circuit) shown in FIG. 1, each HIP apparatus main body comprises a high-pressure vessels 2, an electric furnace 3 and the like. In FIG. 1, when the interior of one HIP apparatus main body out of two HIP apparatus main bodies VSL1 and VSL2 is pressed, the internal pressure of the other HIP apparatus main body is reduced. Such combination of cycles shortens the pressure elevating time and the reducing time.

For example, suppose that the cycle time of one HIP apparatus main body VSL1, VSL2 is one hour, HIP treatment is carried out once 30 minutes, and the productivity is improved twice. In such a treatment in a short period of time, the time required to heat and elevate in temperature the workpiece 5 to a predetermined temperature also poses a problem, and therefore, the workpiece 5 is heated in advance, and the interior of the high-pressure vessel 2 is always placed in a state heated in the vicinity of the temperature of the HIP treatment.

In FIG. 1, the high-pressure piping system comprises a gas cylinder 27 (gas supply source), a compressor 28, a vacuum pump 29, a main opening/closing valve MSV1, 1st to 10th opening/closing valves SV1 to 10, and the like.

A first pipeline K1 having the main opening/closing valve MSV1 interposed is connected to the gas cylinder 27. A second pipeline K2 having the 10th opening/closing valve SV10 interposed and a relief pipeline RK provided with a relief valve RV are connected to the first pipeline K1.

A pressure gauge PG is provided in the relief pipeline RK.

The second pipeline K2 and the first HIP apparatus main body VSL1 are connected by the third pipeline K3 having the third opening/closing valve SV3 interposed. The second pipeline K2 and the second HIP apparatus main body VSL2 are connected by the fourth pipeline K4 having the fourth opening/closing valve SV4 interposed.

The fifth pipeline K5 having the fifth opening/closing valve SV5 interposed is connected between a connection point C1 of the third pipeline K3 with the second pipeline K2 and the third valve SV3. The sixth pipeline K6 having the sixth opening/closing valve SV6 interposed is connected between a connection point C1 of the fourth pipeline K4 with the second pipeline K2 and the fourth opening/closing valve SV4. The fifth pipeline K5 and the sixth pipeline K6 being connected with each other.

The seventh pipeline K7 provided with the seventh opening/closing valve SV7 is connected to the first HIP apparatus main body VSL1. The eighth pipeline K8 provided with the eighth opening/closing valve SV8 is connected to the second HIP apparatus main body VSL2.

The ninth pipeline K9 having the first opening/closing valve SV1 interposed is connected between the third opening/closing valve SV3 of the third pipeline K3 and the first HIP apparatus main body VSL1. The tenth pipeline K10 having the second opening/closing valve SV2 interposed is connected between the fourth opening/closing valve SV4 of the fourth pipeline K4 and the second HIP apparatus main body VSL2. The ninth pipeline K9 and the tenth pipeline K10 being connected with each other.

A connection point C2 between the fifth pipeline K5 and the sixth pipeline K6 and a connection point C3 between the ninth pipeline K9 and the tenth pipeline K10 are connected by the eleventh pipeline K11 having a compressor 28 interposed.

An exhaust pipeline HK having a vacuum pump 29 interposed is connected to the connection point C3 between the ninth pipeline K9 and the tenth pipeline K10. The ninth opening/closing valve SV9 is interposed between the connection point C3 of the exhaust pipeline HK and the vacuum pump 29.

In the following, the operation in a short cycle according to the present invention will be described with reference to FIG. 1, the piping systematic view; FIG. 2, the process view; FIG. 3, the graph; and FIGS. 4 to 11, the flow of the pressure medium gas in the high-pressure piping system.

In the following description, with respect to the HIP apparatus main body and the valves, their names are omitted, and a description will be made by way of the above-described reference numerals or symbols.

In the initial state, the workpiece 5 preheated by the preheating station is carried and inserted into the high-pressure vessel 2 of VSL1, and in VSL2, the workpiece 5 is heated and pressed (in the state of holding temperature and pressure).

MSV1, SV1 to 10 are closed, and the compressor 28 and the vacuum pump 29 are not operated.

Figure 5:
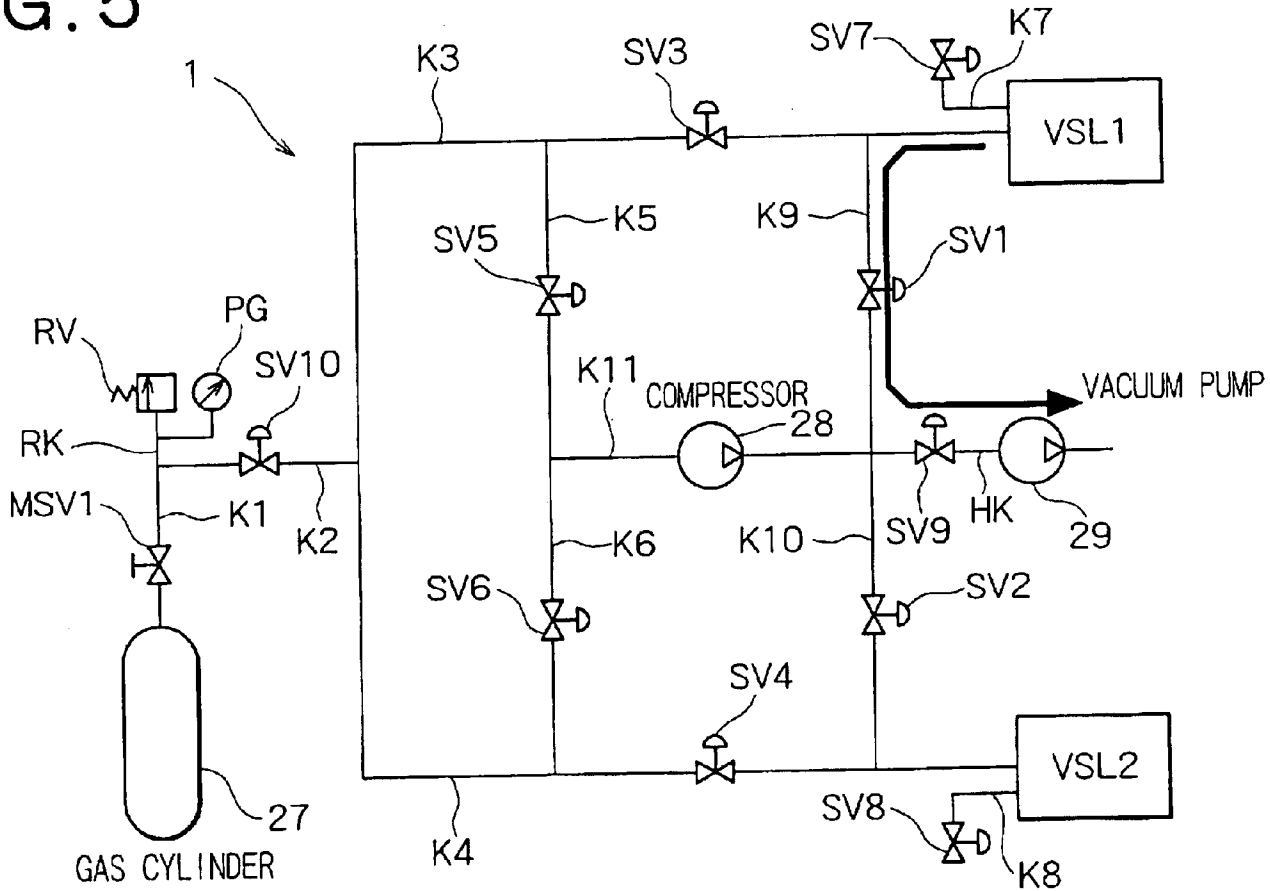
FIG. 5 is a piping systematic view showing a flow of a pressure medium gas.
Figure 6:
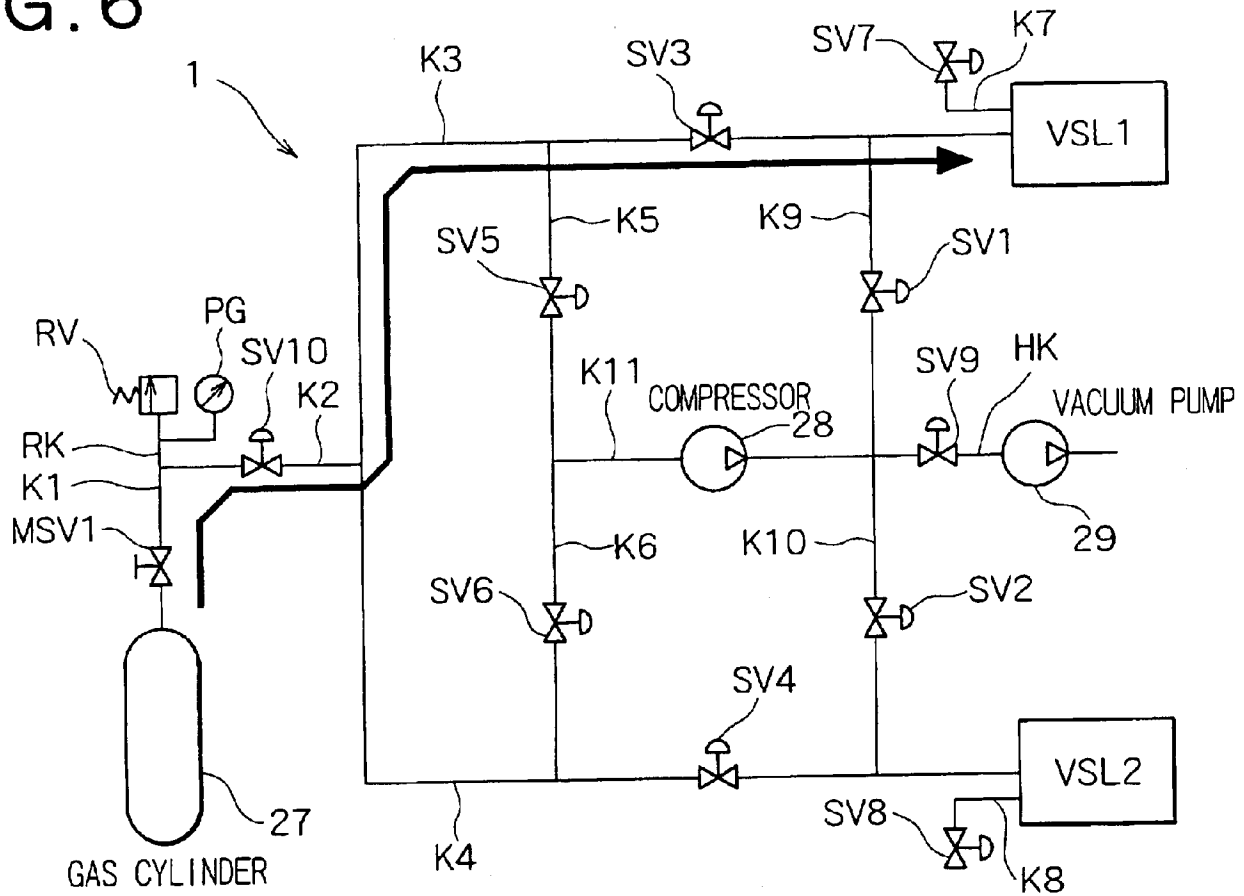
FIG. 6 is a piping systematic view showing a flow of a pressure medium gas.
Figure 7:
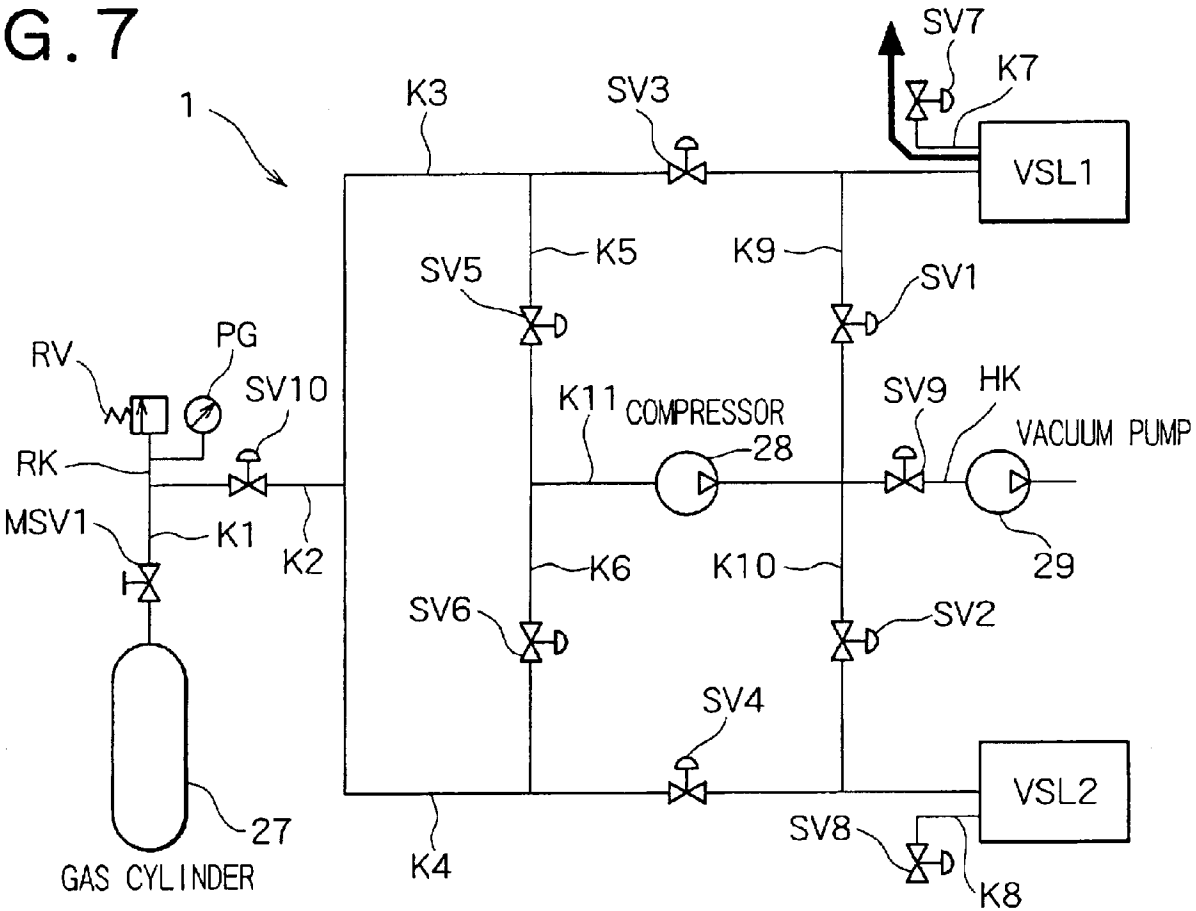
FIG. 7 is a piping systematic view showing a flow of a pressure medium gas.

In this state, the workpiece 5 is inserted into VSL1, SV1 and SV9 are opened, as shown in FIG. 5, the interior of the high-pressure vessel 2 of VSL1 is subjected to vacuum drawing by the vacuum pump 29 (the vacuum drawing can be omitted as the case may be). After the vacuum drawing, as shown in FIG. 6, SV1 and SV9 are closed, MSV1, SV10 and SV3 are opened, the gas for gas exchange is filled at low pressure into VSLI from the gas cylinder 27, and immediately thereafter, SV7 is opened as shown in FIG. 7 to release air-mixed gas to the atmosphere.

Figure 8:
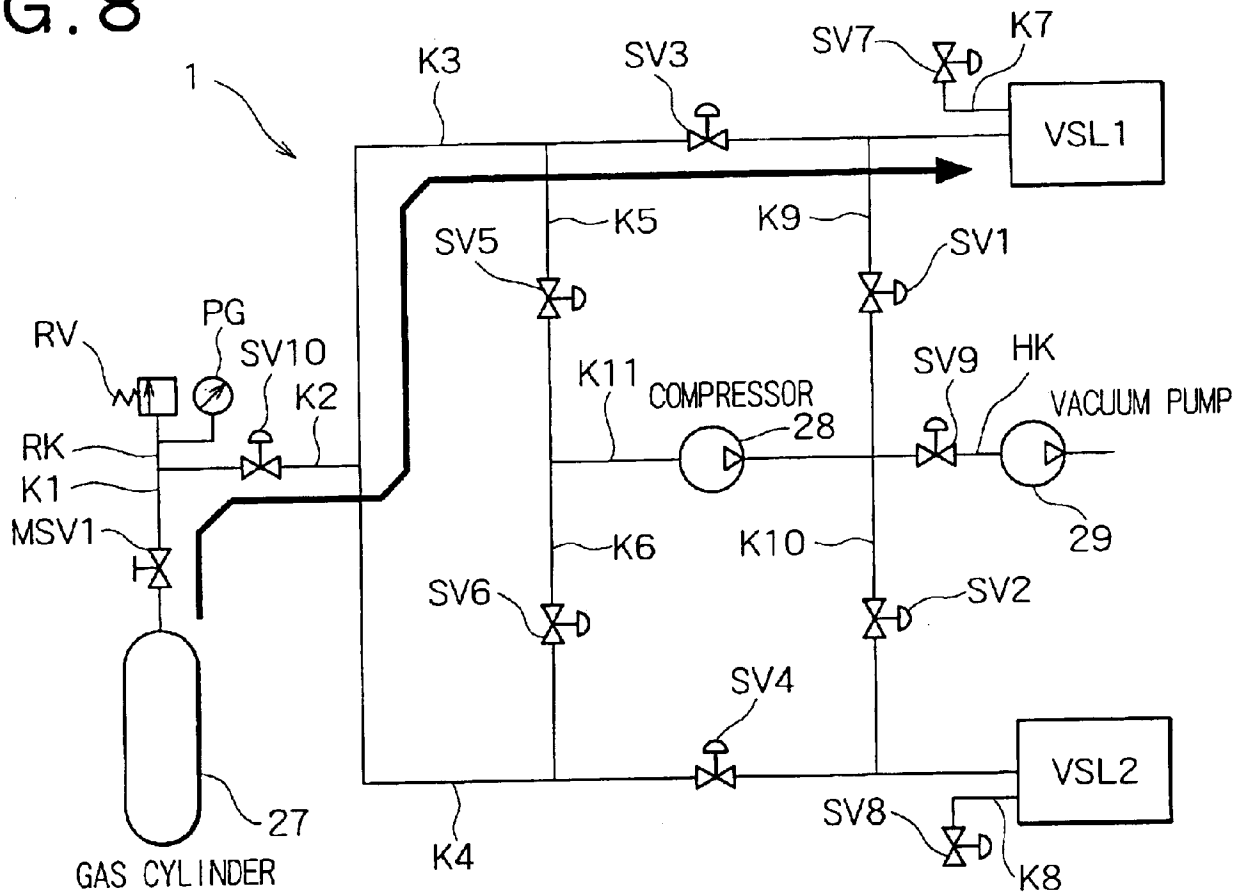
FIG. 8 is a piping systematic view showing a flow of a pressure medium gas.

Then, as shown in FIG. 8, MSV1, SV10, and SV3 are opened, and other valves are closed to fill the pressure medium gas in VSL1 from the gas cylinder 27.

Figure 9:
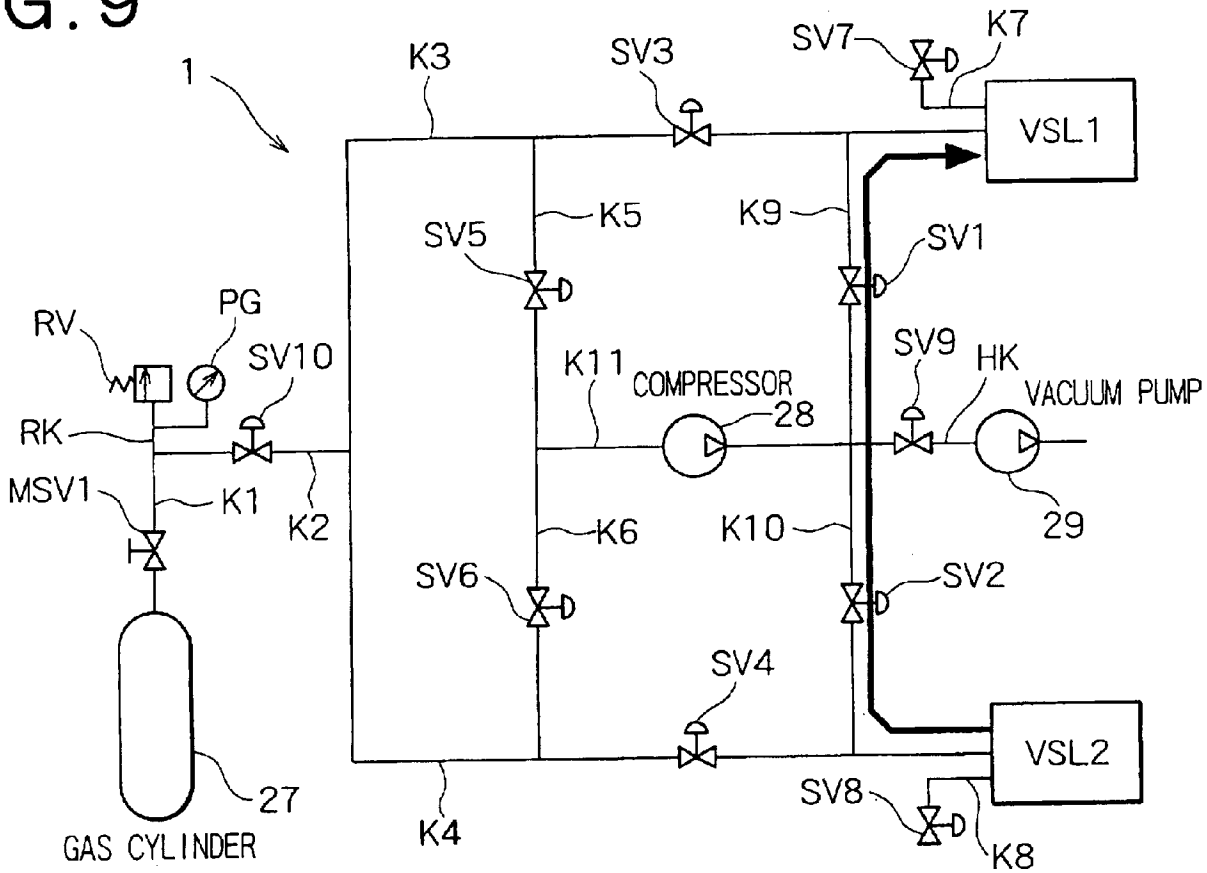
FIG. 9 is a piping systematic view showing a flow of a pressure medium gas.

Thereafter, as shown in FIG. 9, MSV1, SV10 and SV3 are closed, SV1 and SV2 are opened to communicate VSL1 with VSL2, and the gas is filled in differential pressure into VSL1 from VSL2 already subjected to HIP treatment.

Figure 10:
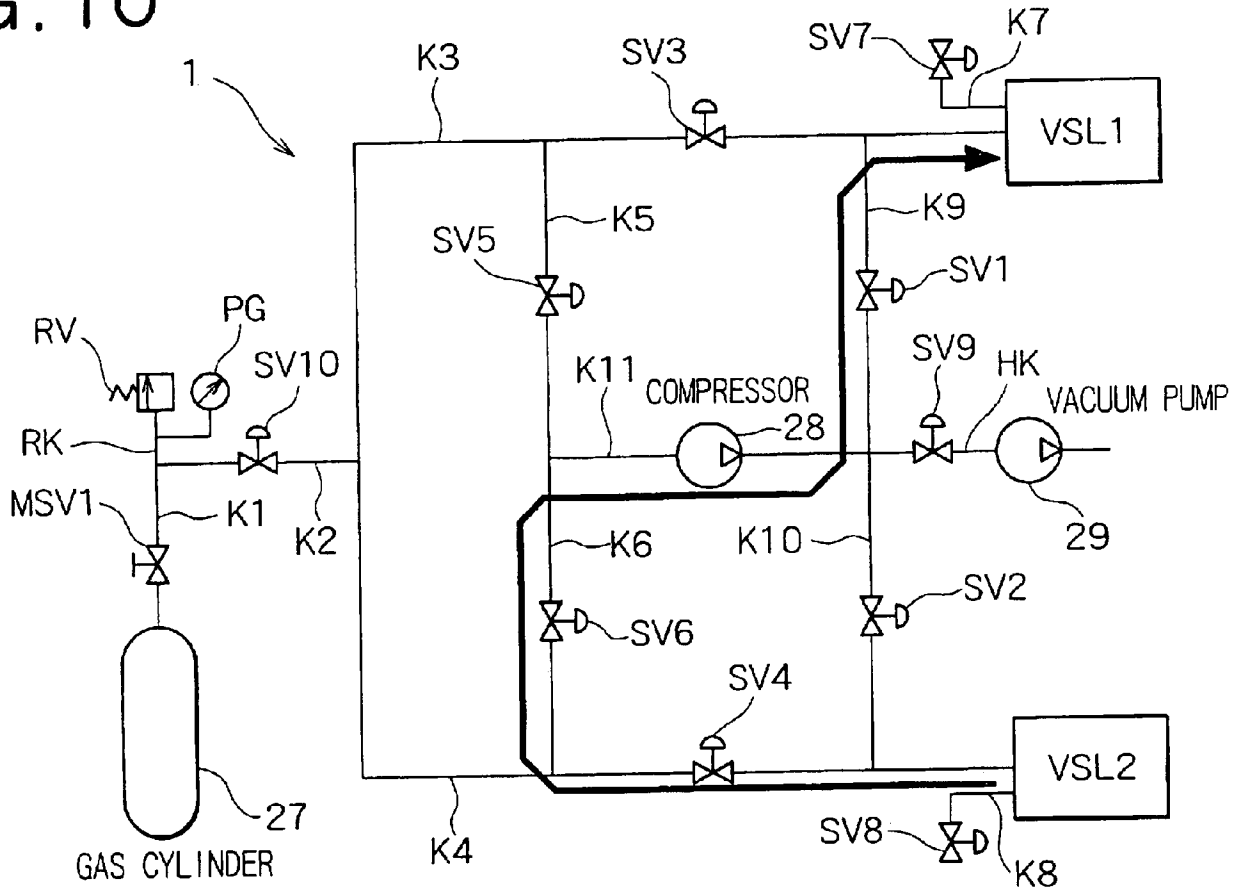
FIG. 10 is a piping systematic view showing a flow of a pressure medium gas.

Thereafter, when pressures (both the high-pressure vessel 2) of VSL1 and VSL2 are nearly balanced and the elevating speed of pressure in VSL1 is lowered, as shown in FIG. 10, SV2 is closed, SV4 and SV6 are opened, and the compressor 28 is driven to suck out the pressure medium gas from VSL2 and press to fill the pressure medium gas in VSL1.

Then, when pressure in VSL1 assumes a predetermined pressure, the operation of the compressor 28 stops.

Figure 11:
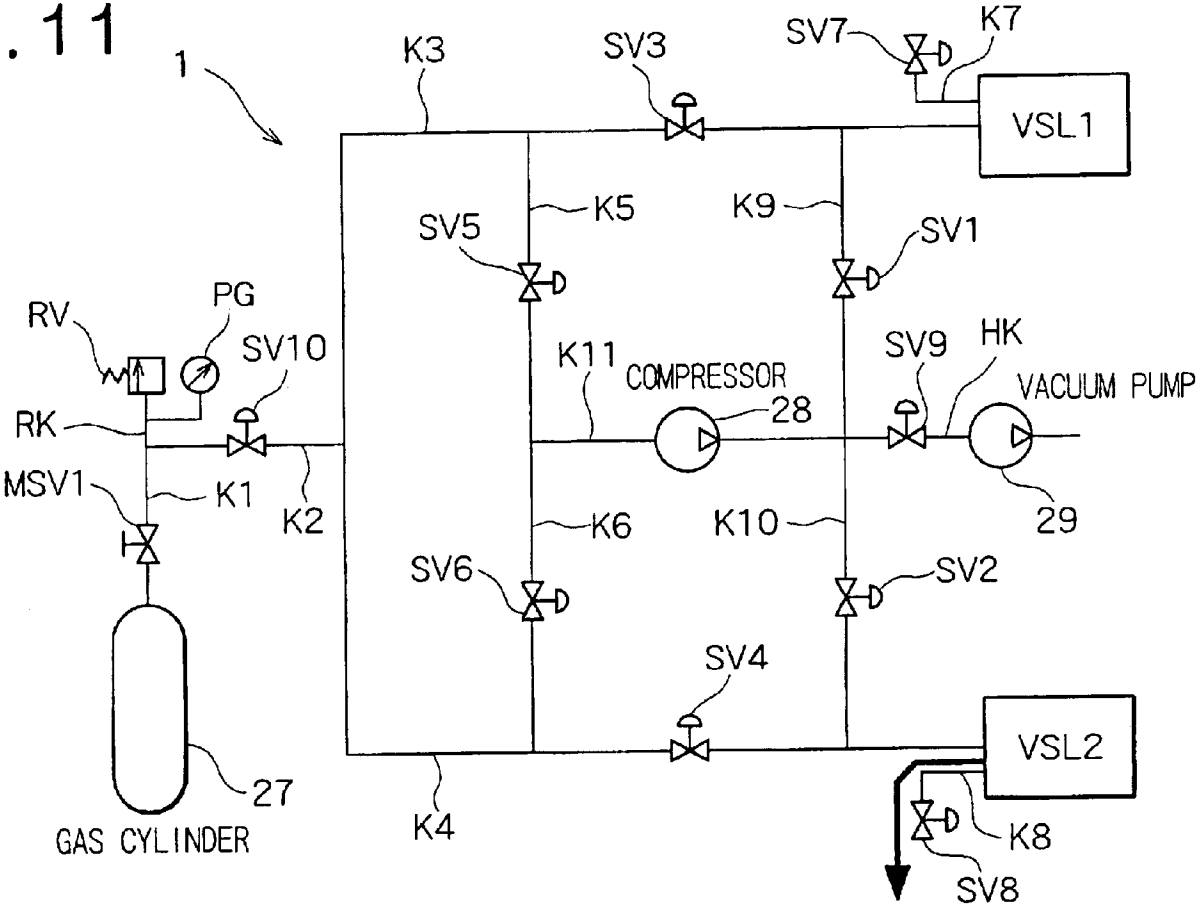
FIG. 11 is a piping systematic view showing a flow of a pressure medium gas.
Figure 12:
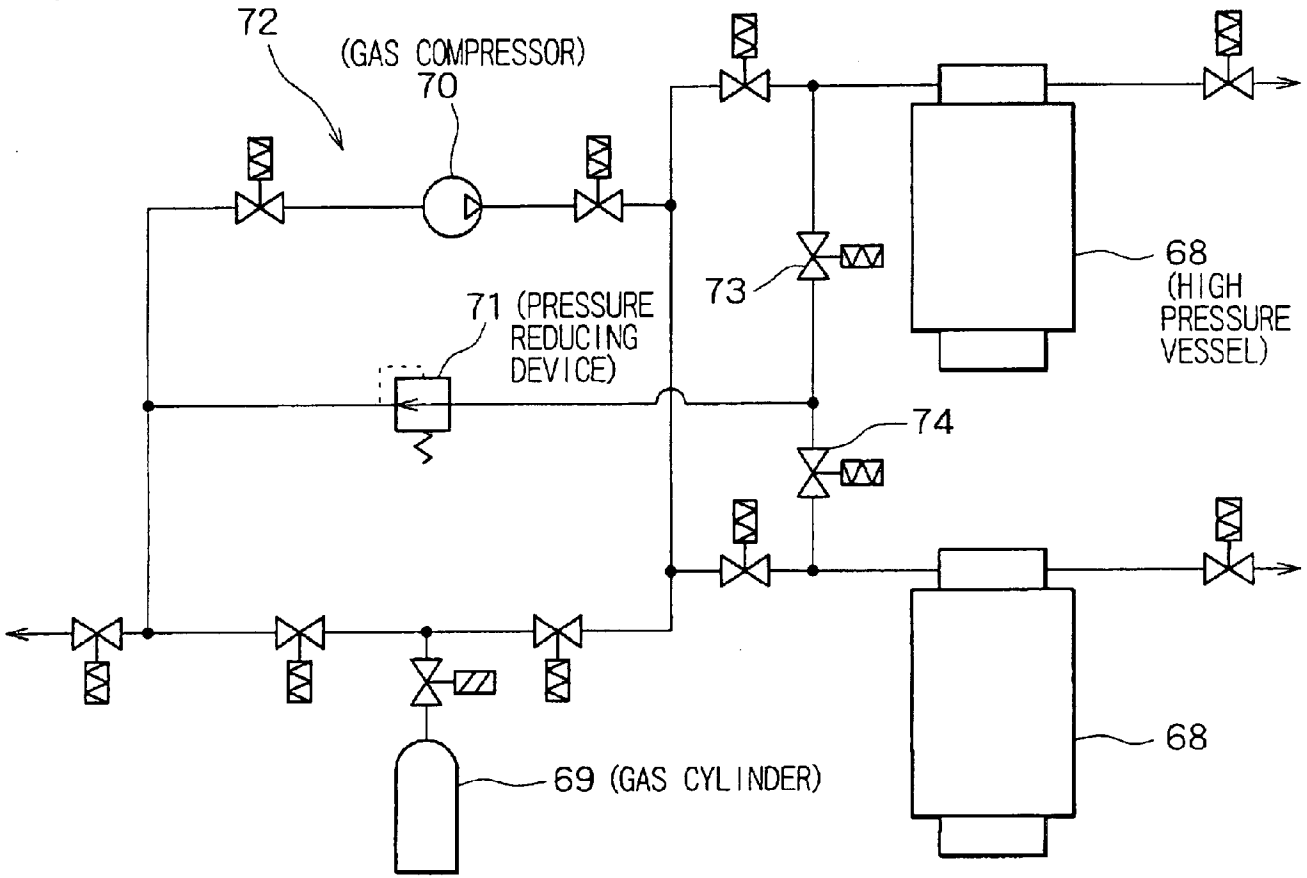
FIG. 12 is a piping systematic view of a conventional HIP apparatus.

At that time, the internal pressure of the high-pressure vessel 2 of VSL2 is equal to or less than the pressure of the gas cylinder 27, and therefore, as shown in FIG. 11, SV1, SV4 and SV6 are closed, and SV8 is opened to release the residual gas in VSL2 to the atmosphere.

At that time, VSL1 is in the state of holding high temperature and high pressure, that is, in the state that the HIP treatment is carried out.

On the other hand, with respect to VSL2, the high-pressure vessel 2 is opened at high temperature and the workpiece 5 therein is taken out in a high temperature state, and as the preparation for succeeding treatment, the workpiece 5 held at a high temperature is inserted.

Then, after the holding high temperature and high pressure (HIP treatment) in VSL1, the above-described procedure is sequentially progressed with respect to VSL2.

In this manner, the pressure cycles of two HIP apparatus main bodies VSL1, VSL2 are adapted to thereby enable operation which is optimized in terms of time as well as energy.

In filling in differential pressure the pressure medium gas from the high-pressure vessel 2 of one HIP apparatus main body VSL1, VSL2 to the high-pressure vessel 2 of the other HIP apparatus main body VSL1, VSL2, the temperature in the high-pressure vessel 2 on the supply side is held at high temperature in the present invention in order to avoid a problem that the pressure medium gas in the high-pressure vessel 2 on the supply side becomes lowered in temperature due to the adiabatic expansion to lower the temperature substantially.

More specifically, the base heater 12 within the high-pressure vessel 2 on the supply side is energized to heat the pressure medium gas within the high-pressure vessel 2 to a holding temperature or that in the vicinity thereof.

It is suggested that since at that time, the workpiece 5 be encased, the fan 13 is driven to prevent the occurrence of temperature distribution.

Further, within the high-pressure vessel 2 on the side in which the pressure medium gas is supplied, the pressure medium gas having passed through the piping route at high speeds loses speed energy at an impinging portion within the high-pressure vessel 2 (normally, an upper end within the high-pressure vessel 2) and at the same time, generates heat (conversion of kinetic energy to heat energy) so that the temperature elevates.

It has been experienced that the temperature elevation reaches by 100 to 200° C. as the case may be, and to prevent that it is suggested that the fan 13 within the high-pressure vessel 2 on the side in which the pressure medium gas is supplied is driven to provide a uniform temperature in the space in the treatment chamber 4.

In the normal HIP treatment, since argon rarely has a problem on reaction with the workpiece 5 or the like, argon is used as the pressure medium gas. However, in a metal material which is a main object of the present invention such as Al alloy, since reaction with nitrogen rarely occurs in a temperature region of the HIP treatment described above, it is suggested that nitrogen be used.

That is, since the compressive property of nitrogen are small by 5 to 10% as compared with argon, the gas quantity of nitrogen necessary for being pressed to the same pressure as that used normally in the case of argon will suffice to be less, and the effect of shortening pressing time can be expected.

Further, nitrogen gas is cheaper than argon gas, which also meets the original object of the present invention, i.e. reduction of the HIP treatment cost.

According to the aforementioned present invention, the HIP treatment of the products which can be carried under the atmospheric pressure at high temperature and which are below 600° C. in HIP treatment temperature such as Al cast articles and Mg cast articles can be carried out with high efficiency, for example, not less than two cycles per hour.

By the reduction of apparatus costs caused by higher efficiency according to the present invention and simplification of the HIP apparatus 1 in the present invention, the HIP treatment cost can be reduced to 1/10 or below of the conventional HIP treatment, and it is possible to apply the invention to Al cast parts of automobiles to which application of conventional HIP treatment has been difficult from a viewpoint of restrictions in terms of treatment costs.

The improvement in fatigue strength and ductility (stretching and drawing) by the HIP treatment itself enables thinner parts easily in terms of designing parts. Lighter weight of automobiles and energy-saving effect associated therewith, and effect of reduction in exhaust gases can be also expected, greatly contributing to the development of automobile industries or the like in future.

We claim:

1. A hot isostatic pressing method for heating/pressing a workpiece using a pair of high-pressure vessels and using a pressure medium gas, the method comprising the steps of:

heating and pressing workpieces in a first high-pressure vessel which is one of said pair of high-pressure vessels;

placing a workpiece in a heating state in a second high-pressure vessel which is the other thereof, while heating and pressing the workpieces in said first high-pressure vessel;

reducing the internal pressure of said first high-pressure vessel, after termination of heating and pressing of the workpieces in said first high-pressure vessel;

pressing the interior of said second high-pressure vessel, while reducing the internal pressure of said first high-pressure vessel; and heating and pressing the workpieces in said second high-pressure vessel, said step of pressing the interior of said second high-pressure vessel and reducing the internal pressure of said first high-pressure comprising:

communicating the interior of said first high-pressure vessel with the interior of said second high-pressure vessel to thereby pour the pressure medium gas released from said first high-pressure vessel into said second high-pressure vessel; and sucking out the pressure medium gas from said first high-pressure vessel by a compressor and pouring the pressure medium gas pressed by the compressor into said second high-pressure vessel, after internal pressure of said first high-pressure vessel and internal pressure of said second high-pressure vessel have assumed a nearly balanced state.

2. The hot isostatic pressing method according to claim 1, wherein, in said step of reducing the internal pressure of said first high-pressure vessel, the interior of said first high-pressure vessel is heated so as to suppress lowering of temperature within said first high-pressure vessel.

3. The hot isostatic pressing method according to claim 1, wherein a base heater and a fan for supplying and stirring the pressure medium gas within a treatment chamber for heating and pressing workpieces are arranged downward of a workpiece in said first high-pressure vessel, and said base heater and said fan are operated so as to provide a uniform temperature in the interior of said first high-pressure vessel, in said step of reducing the internal pressure of said first high-pressure vessel.

4. The hot isostatic pressing method according to claim 1, wherein a base heater and a fan for supplying and stirring the pressure medium gas within a treatment chamber for heating and pressing workpieces are arranged downward of a workpiece in said second high-pressure vessel, and said base heater and said fan are operated so as to provide a uniform temperature in the interior of said second high-pressure vessel, in said step of pressing the interior of said first high-pressure vessel.

5. The hot isostatic pressing method according to claim 1, wherein said pressure medium gas is nitrogen.

6. The hot isostatic pressing method according to claim 1, wherein said workpiece is aluminum or an aluminum alloy.

7. A hot isostatic pressing apparatus, comprising;

a first and a second high-pressure vessels, said first and second high-pressure vessels having means for heating the interior thereof;

pressure medium gas supply means for supplying the pressure medium gas to said first and second high-pressure vessels;

a compressor;

a first gas passage for communicating said first high-pressure vessel with said second high-pressure vessel;

a second gas passage for communicating said first high-pressure vessel with a discharge side of said compressor;

a third gas passage for communicating said second high-pressure vessel with a discharge side of said compressor;

a fourth gas passage for communicating said first high-pressure vessel with an intake side of said compressor; and a fifth gas passage for communicating said second high-pressure vessel with an intake side of said compressor;

said first to fifth gas passages and said compressor capable of assuming at least the following states:

a first state in which all said first to fifth gas passages are closed, and said compressor is stopped;

a second state in which said first gas passage is open, said fourth and said fifth gas passages are closed, and said compressor is stopped;

a third state in which said first gas passage is closed, said third and said fourth gas passages are open, said second and said fifth gas passages are closed, and said compressor is driven to suck out the pressure medium gas from said first high-pressure vessel and supply a high-pressure medium gas to said second high-pressure vessel; and a fourth state in which said first gas passage is closed, said second and said fifth gas passages are open, said third and said fourth gas passages are closed, and said compressor is driven to suck out the pressure medium gas from said second high-pressure vessel and supply a high-pressure medium gas to said first high-pressure vessel.

8. The hot isostatic pressing apparatus according to claim 7, wherein operation can be made at least in the following procedure:

in said first state, a workpiece is heated and pressed in said first high-pressure vessel, and the workpiece is placed in the heated state in said second high-pressure vessel;

after termination of heating and pressing the workpiece in said first high-pressure vessel, the interior of said first high-pressure vessel is reduced and at the same time the interior of the second high-pressure vessel is pressed, in said second state;

after internal pressure of said first high-pressure vessel and internal pressure of said second high-pressure vessel have assumed a nearly balanced state, the interior of said first high-pressure vessel is further reduced, and at the same time, the interior of said second high-pressure vessel is further pressed, in said third state;

in said first state, the workpiece is heated and pressed in said second high-pressure vessel, and the workpiece is placed in a heated state in said first high-pressure vessel;

after termination of heating and pressing the workpieces by said second high-pressure vessel, the internal pressure of said second high-pressure vessel is reduced, and at the same time, the interior of said first high-pressure vessel is pressed, in said second state; and after internal pressure of said first high-pressure vessel and internal pressure of said second high-pressure vessel have assumed a nearly balanced state, the internal pressure of said second high-pressure vessel is further reduced, and at the same time, the interior of said first high-pressure vessel is further pressed, in said fourth state.

9. The hot isostatic pressing apparatus according to claim 7, wherein said first and second high-pressure vessels include the following therein:

a treatment chamber for heating and pressing a workpiece;

a base heater arranged downward of said treatment chamber; and a fan for supplying and stirring the pressure medium gas heated by said base heater into said treatment chamber.

10. The hot isostatic pressing apparatus according to claim 9, wherein said first and second high-pressure vessels further include therein a heat insulating structure for covering the lateral circumference and upper portion of said treatment chamber.

11. The hot isostatic pressing apparatus according to claim 10, wherein said heat insulating structure is constituted capable of being integrally taken out at least with a workpiece and of being carried from the interior of said first and second high-pressure vessels.

* * * * *

UNITED STATES PATENT AND TRADEMARK OFFICE

CERTIFICATE OF CORRECTION

PATENT NO. : 6,837,086 B2
DATED : January 4, 2005
INVENTOR(S) : Manabe et al.

It is certified that error appears in the above-identified patent and that said Letters Patent is hereby corrected as shown below:

Title page,
Item [73], Assignee, should read:
-- [73] Assignee: Kabushiki Kaisha Kobe Seiko Sho (Kobe Steel, Ltd.), Kobe (JP) --

Signed and Sealed this

Twenty-second Day of March, 2005

JON W. DUDAS
*Director of the United States Patent and Trademark Office*